United States Patent [19]

Mutsaers et al.

[11] 4,292,619

[45] Sep. 29, 1981

[54] RESISTANCE MATERIAL

[75] Inventors: Cornelis A. H. A. Mutsaers; Alexander H. Boonstra, both of Eindhoven, Netherlands

[73] Assignee: U.S. Philips Corporation, New York, N.Y.

[21] Appl. No.: 974,643

[22] Filed: Dec. 29, 1978

[30] Foreign Application Priority Data

Jan. 12, 1978 [NL] Netherlands ..... 7800355

[51] Int. Cl.[3] ..... H01C 1/012

[52] U.S. Cl. ..... 338/308; 29/610 R; 252/518; 338/223

[58] Field of Search ..... 338/7, 9, 308–309, 338/307, 223, 224, 100; 252/518; 29/610, 101–103; 427/176

[56] References Cited

U.S. PATENT DOCUMENTS

| | | | |
|---|---|---|---|
| 608,685 | 8/1898 | Kelly | 338/223 X |
| 2,767,289 | 10/1956 | Robinson | 338/223 |
| 3,683,307 | 8/1972 | Patterson | 338/100 X |
| 3,700,857 | 10/1972 | Brandes et al. | 338/223 X |
| 3,711,328 | 1/1973 | Wada et al. | 252/518 |
| 3,775,347 | 11/1973 | Bouchard | 252/518 |
| 3,776,772 | 12/1973 | Asada et al. | 252/518 X |
| 3,778,389 | 12/1973 | Kasanami et al. | 252/520 |
| 3,779,804 | 12/1973 | Urban | 252/518 X |
| 3,798,063 | 3/1974 | Decraene | 252/518 X |
| 3,806,765 | 4/1974 | Matsuoka et al. | 252/518 X |
| 3,899,449 | 8/1975 | Pukaite | 252/518 |
| 3,916,037 | 10/1975 | Brady et al. | 252/518 X |
| 3,960,778 | 6/1976 | Bouchard et al. | 252/518 X |

*Primary Examiner*—C. L. Albritton

*Attorney, Agent, or Firm*—Norman N. Spain

[57] ABSTRACT

Corpuscular material which, while using a whether or not reacting binder, can be processed to resistor bodies. The material consists of corpuscular carrier material of inert oxidic material or, possibly, resistance-determining material, at the surface of which there is an oxidic resistance material retained by chemisorption, such as a noble metal compound. During heating the surface structure is retained. This starting material enables a considerable saving in noble metal compounds.

8 Claims, 1 Drawing Figure

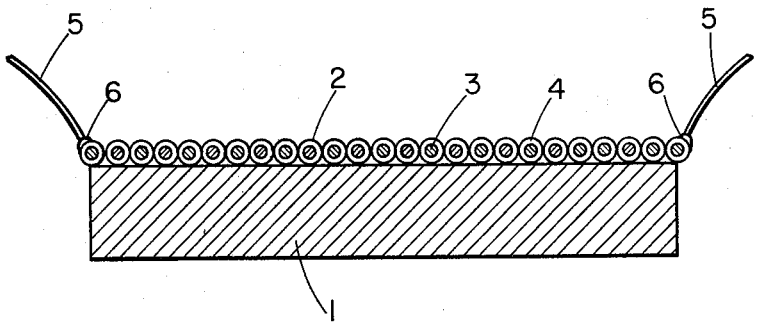
5
5
6
2
3
4
6
1

RESISTANCE MATERIAL

BACKGROUND OF THE INVENTION

The invention relates to resistance material consisting of one or more metal oxides and/or one or more compounds of metal oxides with a whether or not reacting vitreous binder and resistor bodies produced therefrom.

Such a resistance material is known from, for example, U.S. Pat. No. 3,778,389. To prepare this resistance material one or more metal oxides are heated after addition of a powdered glass frit as a binder. By varying the ratio of, for example, two oxides it is possible to obtain a variation in the resistance value, but particularly the variation of the ratio of the resistance material to the binder may furnish a range of resistance values varying from, for example, a value of $10-10^6$ Ohm.cm.

This material has the drawback, that a rather large quantity of the noble metal oxides or compounds, which are usually used, is required.

A further drawback is that when preparing the known resistance materials one cannot independently control the amount of the temperature coefficient of the resistance (TCR). Some compounds possess metallic conductivity, the resistance value linearly increasing with the temperature, and other compounds have a semiconductor character, the resistance value decreasing in accordance with an e-function when the temperature increases.

If with a certain ratio of a chosen conductive component and a binder a certain, low TCR has been adjusted positively or negatively, it appears that when the ratio conductor to binder is changed, not only the level of the resistance value changes but that also another value of the TCR is obtained.

BRIEF SUMMARY OF THE INVENTION

It is an object of the invention to provide a resistance material for which comparatively less noble metal is required and with which it is possible to provide a range of resistance values without a considerable change in the TCR and wherein the TCR can be adjusted to an arbitrary and, preferably, very low value.

The resistance material of the invention consisting of one or more metal oxides and/or one or metal oxidic compounds, and having an oxidic binder is characterized, according to the invention, in that it consists of a carrier material formed of oxidic particals on the surface of which there is a layer of a thickness between 0.5–100 nm of a dried, soluble metal compound which, by heating, is converted into a resistance-determining oxide or oxidic compound or a layer of the oxide or the oxidic compound itself.

This resistance material can be obtained by dispersing vitreous particles in a liquid medium which contains the relevant soluble metal compound on a dissolved state. With a suitable choice of the pH a charge condition will be established at the surface of the glass particles so that metal ions will be retained by the surface by chemisorption. The pH-values at which this can be effected will be between 6 and 10 for the majority of glasses. The layer thickness of the adsorbed ions may be monomolecular to some monolayers. After filtering off and drying of the particles of adsorbed layer will adhere to the glass. By means of heating the metal compound is converted into a resistance-determining oxidic component or an oxidic compound. A superficial chemical reaction with the glass may then take place. The particle size of the vitreous binder, which functions as the carrier for the resistance-determining materials is not critical. The properties of the resistance are determined by the active surface layer only. For practical reasons the particle size of the glass will be chosen to be not more than approximately 5 μm.

The invention is based on the recognition that a different type of conduction occurs at the surface of the resistance materials as compared with the conduction in the material itself. At the surface, for example, the conduction may be of the semiconductor type (having a negative TCR) and in the material itself it may be of a metallic character having, as a rule, a positive TCR. The result is that for corpuscular resistance material the average particle size and the deviation therein has a great influence on the TCR, because the ratio of the surface conduction to the conduction in the material of the particle is a function of the particle size. As the phenomenon of chemisorption for a chosen system produces a uniform layer thickness of the material, the type of conduction and, consequently, the nature of the TCR will always be the same. Consequently, it is possible to compose a resistance material having an adjustable resistance value and an adjustable and reproduceable TCR. The variables which can be controlled are the particle size of the vitreous carrier, so that the value of the resistance can be chosen, the nature of the dissolved metal compound or metal compounds and, in the latter case, their mutual concentration ratio, so that also the resistance value is adjustable.

The resistance material according to the invention can be processed in the customary manner with a combustible binder into a paste from which resistor bodies can be made, for example by means of screen printing follower by heating. However, heating must be effected at that temperature that the carrier material predominantly maintains its particle structure. Thus only sintering may be employed. If a vitreous carrier material is chosen, heating must consequently be done to a temperature so far above the softening temperature of the glass that the structure of the surface layer is retained and the material is bounded, mutually and to the substrate material. The resistor body obtained consequently consists of a substrate to which a layer of coherent particles obtained in accordance with the invention is bonded and which is provided with electrical connections.

In accordance with a further elaboration of the resistance material according to the invention there is provided between the oxidic resistance-determining layer and the particles of the carrier material a layer of an other compound which stimulates a reaction between said first layer and the carrier material or prevents migration of ions between said first layer and of the particles of the carrier material.

A $Cu^{++}$- of a $Pb^{++}$-compound is preferably used for this intermediate layer, the presence of which creates additional possibilities for obtaining a variation in the TCR.

Finally it is alternatively possible to choose a resistance-determining oxidic compound for the carrier material.

This creates still further possibilities. It is then, for example, possible to provide a particle of material having a negative TCR, with a layer of material having a positive TCR or vice versa. The desired resultant level of the TCR can then be adjusted in a simple manner by an accurate dosing of the outer layer as regards kind of material and thickness.

It is obvious, after the above discussion, that in this embodiment, wherein the support material contributes to the resistance character of the material in its totality, the particle size does indeed have its influence but does not play an important part, in contradistinction to the embodiment wherein the support material does not, or only by means of its surface, contribute to the resistance.

Also this embodiment furnishes an additional parameter in the choice of the resistance level and the TCR.

BRIEF DESCRIPTION OF THE DRAWING

The sole FIGURE in the drawing is a cross-sectional view of a resistor employing the resistance material of the invention.

DETAILED DESCRIPTION OF THE INVENTION

The following embodiments are given by way of a further explanation of the invention.

EXAMPLE 1

A solution of 1 mole (207.9 mg) $RuCl_3$ in 50 ml of water is added to a suspension of 5 g of a lead borosilicate glass having an average particle size of approximately 1 micron and having the following composition in % by weight:

| | | | |
|---|---|---|---|
| PbO | 71.7 | $SiO_2$ | 21.0 |
| $B_2O_3$ | 5.0 | $Al_2O_3$ | 2.3 |

and the suspension is thoroughly stirred. Thereafter the suspension is filtered and the filter residue is dried.

A paste is made of this material with benzylbenzoate and this paste is spread in a layer of approximately 15 μm thick on an aluminium oxide plate. The plate coated with the paste is heated for 10 minutes to 800° C. The resistance layer obtained has a surface resistance of approximately 25 kOhm per square and a temperature coefficient of the resistance $|TCR|$ of $<100\times10^{-6}$. °C.$^{-1}$ As shown in the sole FIGURE of the drawing, a resistor of the invention comprises an aluminum oxide plate 1, coated on one side with the thin resistance layer 2 formed as in Example 1 and consisting of lead oxide and borosilicate glass particles 3 each particle of which is coated with a ruthenium oxide layer 4 formed by the method of Example 1. Wire leads 5 are connected to the resistance layer 2 by a connection means 6 such as solder or the like.

EXAMPLE 2

If a solution of 2.5 mmole (519 mg) $RuCl_3$ in 100 ml water is added to the glass powder suspension of example 1 and the further procedure takes place in accordance with that example 1, with this exception that heating of the plate with paste is now done in air for 10 minutes at 700° C. a resistance of approximately 2 kOhm per square is then measured (layer thickness 15 μm). The value of the $|TCR|$ is also $<100\times10^{-6}$.°C.$^{-1}$.

EXAMPLE 3

A solution of potassium ruthenate, containing 7 mg Ru in 10 ml water, is added to a suspension of 1 g $PbSiO_3$ in 50 ml of water, whereafter 10 ml ethanol is added and the further procedure takes place in accordance with the prescription of example 1. The plates coated with paste are fired in air for 10 minutes at 800° C. The resistance layer (15 μm thick) obtained has a resistance value of approximately 100 kOhm/□ and a $|TCR|$ $<100\times10^{-6}$. °C.$^{-1}$.

EXAMPLE 4

A potassium ruthenate solution containing 35 mg Ru in 50 ml water is added to a suspension of 1 g glass powder, having a particle size of approximately 1 μm and the following composition in % by weight:

| | | | |
|---|---|---|---|
| PbO | 36.9 | ZnO | 11.04 |
| $B_2O_3$ | 18.3 | BaO | 7.1 |
| $SiO_2$ | 22.1 | $Na_2O$ | 1.6 |
| $Al_2O_3$ | 2.6 | | |

in 25 ml water and, thereafter, 10 ml of ethanol. The suspension is thoroughly stirred, filtered and the filter residue is dried.

In the manner described in example 1 the powder obtained is made into a paste which is spread on an aluminium oxide plate. Finally, the plate is fired in air for 10 minutes at 750° C. The resistance layer obtained, which has a thickness of 15 μm, has a value of approximately 5 kOhm/□ and a $|TCR|$ $<100\times10^{-6}$.°C.$^{-1}$.

EXAMPLE 5

A solution of different quentities of, a 0.01 M copper nitrate solution in water is first added to a suspension of the glass powder of example 4 in 25 ml of water and thereafter 10 ml of a solution of potassium ruthenate containing 7 mg Ru and, finally, 10 ml ethanol are added. The suspension is filtered after stirring and the filter residue is dried. The powder obtained is processed with benzylbenzoate into a paste and spread on an aluminium oxide plate. Thereafter the plate is heated in air for 10 minutes at 800° C.

The following table shows the resistance values and the TCR, based on different quantities of copper nitrate. The layer thickness is 15 μm.

| Addition $Cu(NO_3)_2$ in mg | R KOhm/□ | TCR $\times 10^{-6}$/°C. |
|---|---|---|
| none | 180 | −240 |
| 3.75 | 200 | −150 |
| 18.75 | 170 | −30 |
| 37.5 | 220 | +140 |

EXAMPLE 6

A solution of different quantities of a 0.01 M lead nitrate solution in water is first added to a suspension of the glass powder of example 4 in 25 ml of water, thereafter 10 ml of a potassium ruthenate solution containing 10 mg Ru and thereafter 10 ml of ethanol are added.

Powder is recovered from the suspension in the same manner as described in example 5, processed to a paste and spread in this form on an $Al_2O_3$ plate. The plate is fired in air for 10 minutes at 750° C. (layer thickness 15 μm), the results are shown in the following table.

| Addition $Pb(NO_3)_2$ in mg | R KOhm/□ | TCR $\times 10^{-6}$/°C. |
|---|---|---|
| none | 30 | −260 |
| 16.56 | 34 | −130 |

-continued

| Addition $Pb(NO_3)_2$ in mg | R KOhm/□ | TCR $\times 10^{-6}$/°C. |
|---|---|---|
| 33.12 | 30 | +30 |
| 66.24 | 28 | +200 |

EXAMPLE 7

Bismuth ruthenate ($Bi_2Ru_{O7}$) is prepared by heating stoichiometric quantities $Bi_2O_3$ and $RuO_2$ for 1 hour at 900° C. The reaction product is milled to an average grain size of 1 μm. Different quantities of $Pb(OH)_2$ are deposited on this powder by stirring the powder in 50 ml of water, in which different quantities of $Pb(NO_3)_2$ have been dissolved and which is thereafter brought to a pH of 8 with ammonia. The powders obtained are fired for 15 minutes 850° in air, stirred for 15 minutes in a 2 M lactic acid solution at 100° C., filtered and dried.

Together with glass powder of example 4 and benzyl benzoate the powders are processed to pastes and the pastes are spread on $Al_2O_3$ plates. The plates are baked for 10 minutes at 600° C.

| Powder composition | Weight ratio powder:glass | R KOhm/□ | TCR $\times 10^{-6}$/°C. |
|---|---|---|---|
| $Bi_2Ru_2O_7$ | 1:1 | 2.0 | −300 |
| id + 1 mole % $Pb_2Ru_2O_7$ at the surface | 1:0.9 | 1.9 | −190 |
| id + 2 mole % $Pb_2Ru_2O_7$ at the surface | 1:1 | 2.1 | −90 |
| id + 5 mole % $Pb_2Ru_2O_7$ at the surface | 1:1.1 | 2.2 | +20 |
| id + 7 mole % $Pb_2Ru_2O_7$ at the surface | 1:1.2 | 1.8 | +120 |

EXAMPLE 8

Lead ruthenate is prepared by mixing a potassium ruthenate solution and a lead nitrate solution, the latter in an excess of approximately 300%, by filtering the precipitate formed by heating the filter residue for 1 hour at 750° C. and by stirring it thereafter into a 2 M lactic acid solution. After filtering the residue, which has an average grain size of 0.03 μm, is dried. The lead ruthenate is treated with different concentrations of bismuth nitrate solutions and thereafter treated in exactly the same manner as in example 7, the powders being heated for 15 minutes at 850° C. and the coated $Al_2O_3$ plates for 10 minutes at 600° C.

| Powder composition | weight ratio powder:glass | R KOhm/□ | TCR $\times 10^{-6}$/°C. |
|---|---|---|---|
| $Pb_2Ru_2O_7$ | 1:2.5 | 11 | +400 |

-continued

| Powder composition | weight ratio powder:glass | R KOhm/□ | TCR $\times 10^{-6}$/°C. |
|---|---|---|---|
| id + 3 mole % $Bi_2Ru_2O_7$ at the surface | 1:2.4 | 12.5 | +270 |
| id + 7 mole % $Bi_2Ru_2O_7$ at the surface | 1:2.3 | 9.8 | +140 |
| id + 10 mole % $Bi_2Ru_2O_7$ at the surface | 1:2.2 | 11.2 | +20 |
| id + 15 mole % $Bi_2Ru_2O_7$ at the surface | 1:2.0 | 10.5 | −110 |

What is claimed is:

1. A resistance material consisting essentially of oxidic particles, each of said particles coated with a resistance determining layer of a thickness of between 0.5–100 nm of at least one resistance determining material selected from the group consisting of resistance determining oxides and oxidic compounds.

2. A material adapted for the preparation of the resistance material of claim 1 consisting essentially of oxidic particles, each particle being coated with a layer of a thickness of between 0.5–100 nm of a dried soluble metal compound convertible by heating to a resistance determining material selected from the group consisting of resistance determining oxides and resistance determining oxidic compounds.

3. The resistance material of claim 1 wherein the oxidic particles are formed of a resistance determining compound.

4. The resistance material of claim 1 wherein between the oxidic particles and the resistance determining coating there is present a layer of a compound capable of preventing migration of ions between said resistance determining coating and said oxidic particles.

5. The resistance material of claim 1 wherein between the resistance determining layer and the oxidic particles there is provided a layer of a compound which is capable of stimulating a reaction between said resistance determining layer and said oxidic particles.

6. A method of forming the resistance material of claim 1 comprising dispersing oxidic particles in a solution of at least one metal compound capable of being heat convertible into a resistance determining material selected from the group consisting of resistance determining oxides and resistance determining oxidic material, filtering the resultant suspension, drying said filtrate, forming a paste of said dried filtrate with an organic binder and then sintering said paste.

7. A method of producing a resistor body comprising forming a paste of the resistance material of claim 1 and an organic binder, applying said paste to a substrate and heating said paste to the sintering temperature thereof, whereby the structure of the surface layer is retained and the material is bonded to itself and to the substrate.

8. A resistor consisting of a substrate to which substrate there is bonded a resistance layer of claim 1 and electrical conductive leads electrically connected to said resistance layer.

* * * * *